United States Patent [19]

Eck

[11] 4,028,005

[45] June 7, 1977

[54] IMPELLER BLADE REINFORCEMENT

[76] Inventor: Bruno Eck, Geisbergstrasse 24, 5 Cologne 41 Klettenberg, Germany

[22] Filed: Apr. 16, 1975

[21] Appl. No.: 568,406

[30] Foreign Application Priority Data

Apr. 24, 1974 Germany ..... 2419651

[52] U.S. Cl. ..... 416/186 R; 416/194

[51] Int. Cl.[2] ..... F04D 29/24

[58] Field of Search ..... 416/186, 186 A, 224, 416/194, 187, 183; 415/213 R

[56] References Cited

UNITED STATES PATENTS

| | | | |
|---|---|---|---|
| 113,592 | 4/1871 | Staples | 416/186 |
| 184,345 | 11/1876 | Croft et al. | 416/194 |
| 991,134 | 5/1911 | Capell | 416/183 |
| 1,030,561 | 6/1912 | Blackmer et al. | 41/186 |
| 1,086,686 | 2/1914 | Neumann | 416/183 |
| 1,186,822 | 6/1916 | Neumann | 416/183 |
| 1,217,386 | 2/1917 | Banner | 416/186 |
| 1,246,090 | 11/1917 | Hagen | 416/186 |
| 1,953,064 | 4/1934 | Dowson | 416/186 |
| 1,983,201 | 12/1934 | Van Rijswijk | 416/186 |
| 1,985,705 | 12/1934 | Whiton | 416/224 X |
| 3,902,823 | 9/1975 | Minato et al. | 416/186 |

FOREIGN PATENTS OR APPLICATIONS

| | | | |
|---|---|---|---|
| 119,671 | 2/1971 | Denmark | 416/186 |
| 889,341 | 1/1944 | France | 416/186 |
| 698,234 | 11/1940 | Germany | 416/186 |
| 858,284 | 12/1952 | Germany | 416/186 |
| 707,810 | 4/1954 | United Kingdom | 416/186 |
| 942,648 | 11/1963 | United Kingdom | 416/186 |

*Primary Examiner*—Everette A. Powell, Jr.
*Attorney, Agent, or Firm*—Temple Clayton

[57] ABSTRACT

A drum-type impeller for a centrifugal blower is provided with reinforcement against damage by centrifugal force at high peripheral speeds by reinforcing means such as gussets or rods running from the underside of each blade toward either or both of the hub disk and inlet ring and inserted near the attachment thereat of the trailing blade. Vortex formation at the underside of a blade inforced by a gusset is reduced by providing a notch at the point of attachment of the blade at approximately the same radial distance as the leading edge of the gusset. Vortex formation at the trailing surface of a gusset is relieved by using a double gusset with a slot between.

5 Claims, 11 Drawing Figures

IMPELLER BLADE REINFORCEMENT

This invention relates to impeller blades and impellers and particularly to drum impellers with backwardly inclined or backwardly curved for centrifugal fans or blowers operating at high tip speeds. More particularly, this invention relates to reinforcement means to decrease the tendency for self-deformation of such centrifugal fan or blower impellers at high tip speeds and further relates to drum impellers having reinforced wide blades.

At the present time, centrifugal fans have drum impellers with blades which are raked so that the leading edge is closer to the axis than the trailing edge thus having an internal diameter to external diameter ratio which may vary from about 0.5 to 0.9. The blades may be backwardly inclined, i.e., straight without any curvature, also termed retroinclined, or backwardly curved, sometimes termed retrocurved, so that they are curved from leading edge to trailing edge with a convex surface facing forward and upward. Blowers with retrocurved blades may have efficiencies of up to 90 percent. However, the slope of the blade with respect to the circumference of the impeller introduces the disadvantage that the blades are relatively susceptible to deformation or breakage due to centrifugal forces when operating at high speeds. The outer surfaces of such impellers may be operating at speeds, i.e., tip speeds, at least as great as 2 to 4 km/min (about 30 to 70 meters per second). For some purposes, even higher tip speeds, e.g., up to 10 km/min or more (about 170 m/sec) may be necessary as when greater volumes of gases are to be transported or higher pressures are to be attained.

This disadvantage is particularly evident with impellers formed of non-metallic materials such as plastics or synthetic resins, even when reinforced with fiber glass, because such materials rapidly approach stresses which cause rupture and disintegration of the impeller. Metallic impeller blades react to centrifugal forces by deformation but may ultimately strike against the casing and disintegrate. When the disintegration of an impeller composed of metals or plastics operating at the high tip speeds occurs suddenly, it may be with the explosive force of a bomb creating very real hazards to personnel in the vicinity as well as causing damage to facilities in the vicinity. Because impellers made of plastics, etc., are often made with non-curved blades, they are especially weak. Such impellers have the advantage of generating relatively high pressures although at low efficiencies but are limited in applicability because of their weak blade structure.

It has heretofore been attempted to overcome these disadvantages of backwardly curved or backwardly inclined impeller blades by profiling the blades to airfoil cross sections or by inserting rings of reinforcement running peripherally of the impeller from blade to blade as shown, for example, by ring 50 in FIGS. 13 and 14 of U.S. Pat. No. 3,306,528. Both methods are costly and difficult. Profiled blades have certain other disadvantages.

It is an object of this invention to provide impellers and particularly drum impellers of enhanced strength for centrifugal fans and blowers. A further object of the invention is to decrease the tendency for impeller blades for centrifugal fans and blowers to rupture at high tip speeds. Other objects will become evident hereinelsewhere.

In accordance with these and other objects of the invention, it has been found that many of the disadvantages of impellers for centrifugal fans and blowers having backwardly curved or backwardly inclined blades are overcome by providing reinforcing means, such as gussets or rods, in the space between adjacent blades running from approximately the center of the outer edge of each blade toward the hub disk of the impeller and attached to the hub disk near the attachment of the adjacent trailing blade. Those of skill in the art will recognize that reinforcement means may also be directed to the inlet ring and that means may be directed to both hub disk and inlet ring either from the midpoint of the blade or from point either side of the midpoint and that such combined reinforcement means may be gussets or rods or one of each. It is also possible to provide reinforcing means such as a gusset split in two parts, a double or dual gusset, with a small intervening slot which assists in improving flow conditions at the trailing surface of the gusset. It will also be apparent that rods may be of other than circular cross-section. Gussets start at the trailing edge of the blade to which attached and run toward the leading edge thereof. Preferably, they run only to the midpoint between trailing edge and leading edge. Greater deformation forces are exerted near the trailing edge.

The invention is now more particularly described with reference to the accompanying drawings which are intended to be diagrammatic of drum impellers according to the invention.

Figure 1:
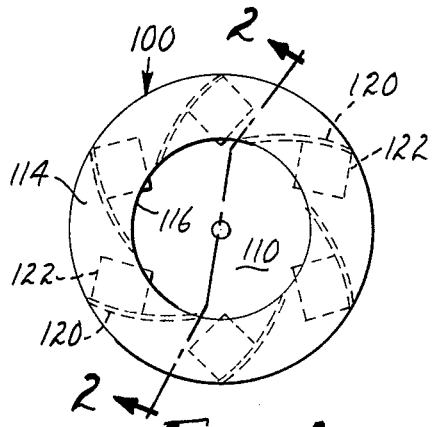
FIG. 1 is a view of an impeller of the invention at the inlet ring with housing of conventional volute design omitted.

Referring now again to the drawings, FIG. 1 shows an impeller according to the invention viewed from the inlet side. It is shown with only six blades for convenience in representation but those of skill in the art will readily recognize that many more blades may be used and will be needed in large units. Inasmuch as the present invention is independent from the exact form of the inlet ring and housing, the latter is omitted entirely and the former is shown schematically as a ring.

FIG. 1 shows the main features of a centrifugal fan or impeller. It is mounted in a conventional volute casing or housing (not shown). Impeller 100 consists of hub disk 110, attached by shaft 112 to driving means 118, inlet ring 114 with central intake 116 and with backwardly curved blades 120. In accordance with the invention, the blades are reinforced by reinforcements 122 secured as by welding at about the midpoint of the width of blades 120 and extending diagonally to hub disk 110. This effectively minimizes the deflection of the blades caused by centrifugal forces as will be explained in greater detail hereinbelow. As pointed out above, the reinforcing means may be varied within the contemplation of the invention.

Figure 2:
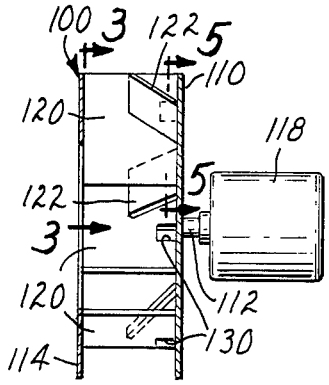
FIG. 2 is a cross-section of the impeller of FIG. 1 along lines 2—2 with inlet ring shown diagrammatically as an annulus.
Figure 4:
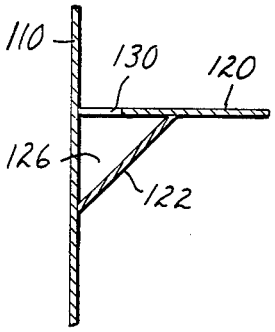
FIG. 4 is a cross-section along line 4—4 of FIG. 3 showing the triangular flow channel formed between a reinforcing strut and the blade in an impeller of the invention.
Figure 3:
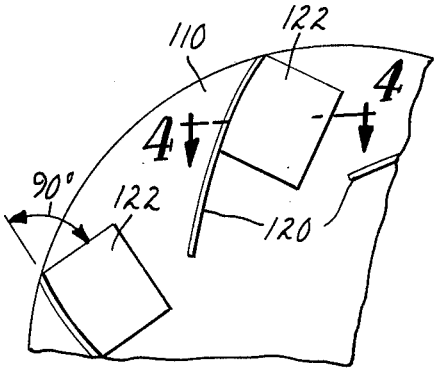
FIG. 3 is a cross-section of a portion of an impeller of the invention as shown in FIG. 2 along the line 3—3.
Figure 5:
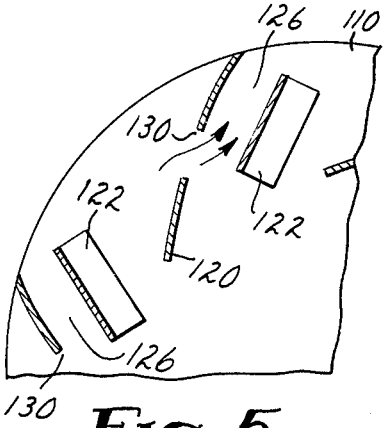
FIG. 5 shows a cross-section along 5—5 of the impeller of FIG. 2 showing a notch for bleeding air or other gas from pressure to suction sides of the blade.

FIG. 3 shows an enlarged partial cross-section at 3—3 of the impeller of FIGS. 1 and 2 and FIG. 4 shows the section along line 4—4 of FIG. 3 showing the triangular channel 126 formed between blade 120, hub disk 110 and reinforcement 122. Because triangular channel 126 increases the frictional area, it may reduce the flow volume. FIG. 5 shows an enlarged partial cross-section along line 5—5 of FIG. 2 with slot or opening 130 in blade 120 opening unto triangular channel 126 by bleeding air or gas from the pressure side of blade 120 to the suction side of blade 120 in triangular channel 126. Slot 130 assists in improving flow conditions by reducing the tendency for flow separation which results in vortex formation. This function may also be performed with respect to reinforcement 122 by leaving an open slot therein as noted hereinabove using a double gusset spaced apart by a small amount. Slot 130 is positioned in blade 120 approximately opposite the inner edge of reinforcement 122 and occupies an area of only a small percentage of the area of blade 120, preferably less than about 3 percent.

Figure 6:
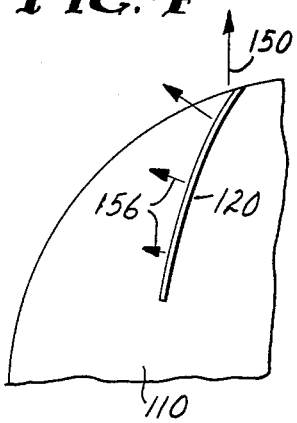
FIGS. 6 and 7 show schematically the centrifugal forces acting on blades of drum impellers in centrifugal blowers in which the blades are retrocurved or retroinclined and the components of the force tending to deform the blades.
Figure 7:
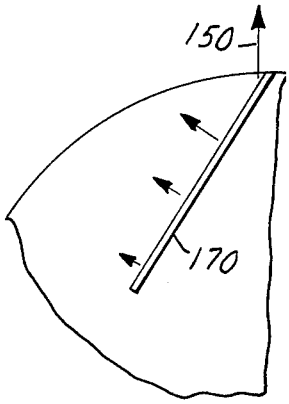

The centrifugal forces acting on backwardly curved blades 120 are shown as vector 150 in FIG. 6. The vectorial components 156 of these forces perpendicular to the blades are the actual forces acting to deform the blades. These components 156 also called "normal forces", increase from the leading inlet edge of the blades to the trailing outer outlet end of the blades because of the increase of centrifugal forces with increase of radial distance from the axis of rotation. Using the same indicia, FIG. 7 shows the forces acting on a retroinclined blade 170. Retroinclined blades are especially subject to deformation because they lack the reinforcing effect resulting from curvature.

Figure 8:
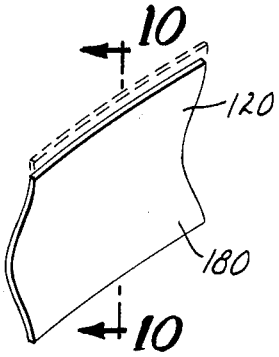
FIGS. 8 and 9 show the deformation induced in blades of the prior art as effected by the forces shown in FIGS. 6 and 7.
Figure 9:
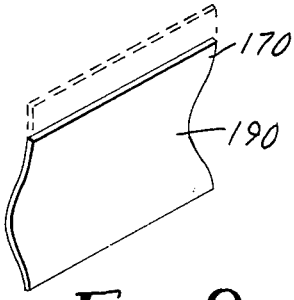

The effects of the deformation is illustrated graphically in FIG. 8 which shows, in solid lines, deformed blade 180 resulting from the action of normal forces on original blade 120 shown in broken lines. Similarly, FIG. 9 shows in solid lines deformed retroinclined blade 190 resulting from the action of normal forces on retroinclined blade 170. The deformation of blades 120 and 170 decreases the width of the impeller and the deformation at the outlet side will eventually strike against the casing while the decrease in width will tend to result in reduced efficiency.

Figure 10:
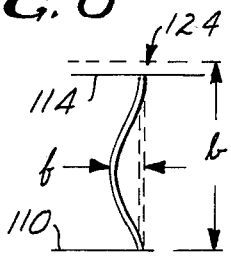
FIG. 10 shows the deformation at 10—10 of FIGS. 8 and 9.

The deformation which can occur may be of considerable magnitude. FIG. 10 shows as section at 10—10 of FIG. 8, the deformation or deflection $f$ of a retrocurved blade under a high centrifugal force. This deformation makes the inlet ring 114 move towards the hub disk 110 so that it assumes the position marked 214. Let the amount of the deflection resulting from deformation be designated by $f$. When a reinforcing plate 122 is inserted in accordance with the invention as shown in FIG. 11, deflection is designated $f'$ and the new position of inlet ring 214 as shown in FIG. 11 is not so far displaced laterally.

Figure 11:
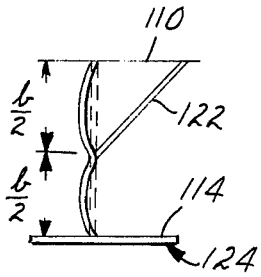
FIG. 11 shows the deformation under centrifugal force of a blade reinforced according to the invention as shown in the section of FIG. 4.

Assuming that the total deforming normal force P acts on a blade as shown in FIGS. 10 and 11 with width $b$, then according to the known rules of strengths of materials, the magnitude of the deflection $f$ in FIG. 10 can be calculated to be:

$$f = \frac{P \cdot b^3}{48 \cdot E \cdot I}$$

where $E$ is the modulus of elasticity and $I$ is the moment of inertia. The magnitude of the deflection $f'$ in FIG. 11 assumes the value:

$$f' = \frac{P(b/2)^3}{48\ E\ I}$$

Hence, $f'/f = 1/8$. In other words, the deflection $f'$ of an impeller blade reinforced according to the invention is only 1/8 of the deflection of the unreinforced blade.

The effect of the reinforcing mean 11 in accordance with the invention is thus seen to be significant. In comparison to an impeller of the previous unreinforced construction, an impeller according to the invention having a reinforcing plate as described hereinabove can attain 40 percent greater tip speeds thus generating twice as high a pressure and effecting an increase of the flow volume by 50 percent. That means, that the impeller delivers half again as much air or gases as an impeller of the previous construction.

What is claimed is:

1. A centrifugal impeller having sides consisting of a circular hub disk and an annular inlet ring, impeller blades, and gusset plates attached to said blades in the space between each blade and the adjacent trailing blade, said impeller blades being securely attached to said hub disk and said inlet ring at their ends and having pressure sides and suction sides and further having inner leading inlet edges and outer trailing outlet edges, one said gusset plate being attached along one edge to the suction side of each said impeller blade from the outer trailing edge thereof along a line at right angles to said trailing edge of said blade, said line being not closer than one fourth the distance between said hub disk and said inlet ring from either end of said blade; said gusset plate being attached to said blade at an acute angle to said impeller blade so that the edge of said gusset plate opposite the edge attached to said impeller blade is attached to a side of said impeller.

2. A centrifugal impeller according to claim 1 wherein the impeller blades are retrocurved.

3. A centrifugal impeller according to claim 1 wherein the impeller blades are retroinclined.

4. A centrifugal impeller according to claim 2 wherein the gusset plate runs from approximately the center of the outer trailing edge of one blade toward the hub disk and is attached to the hub disk near the attachment of the adjacent trailing blade.

5. A centrifugal impeller according to claim 4 additionally having a notch cut in each impeller blade along the end thereof attached to the hub disk and at approximately the same distance from the center of the impeller as the nearest edge of the gusset plate running from said blade.

* * * * *